US009437913B2

(12) United States Patent
Yatabe

(10) Patent No.: US 9,437,913 B2
(45) Date of Patent: Sep. 6, 2016

(54) DIELECTRIC WAVEGUIDE COMPRISED OF A DIELECTRIC BLOCK AND A DIELECTRIC PLATE SANDWICHING AN INPUT/OUTPUT FEEDER LINE

(71) Applicant: TOKO, INC., Tsurugashima-Shi (JP)

(72) Inventor: Yukikazu Yatabe, Wako (JP)

(73) Assignee: TOKO, INC., Saitama (JP)

( * ) Notice: Subject to any disclaimer, the term of this patent is extended or adjusted under 35 U.S.C. 154(b) by 46 days.

(21) Appl. No.: 14/229,397

(22) Filed: Mar. 28, 2014

(65) Prior Publication Data

US 2014/0292438 A1 Oct. 2, 2014

(30) Foreign Application Priority Data

Mar. 29, 2013 (JP) ..... 2013-071502

(51) Int. Cl.

| | |
|---|---|
| ***H01P 5/10*** | (2006.01) |
| ***H01P 3/16*** | (2006.01) |
| ***H01P 1/20*** | (2006.01) |
| ***H01P 5/08*** | (2006.01) |

(52) U.S. Cl.

CPC ..... *H01P 5/1022* (2013.01); *H01P 1/2002* (2013.01); *H01P 3/16* (2013.01); *H01P 5/087* (2013.01)

(58) Field of Classification Search

CPC ..... H01P 5/1022; H01P 1/2002; H01P 3/16
USPC ..... 333/26
See application file for complete search history.

(56) References Cited

U.S. PATENT DOCUMENTS

| | | | | |
|---|---|---|---|---|
| 5,770,989 | A * | 6/1998 | Ishikawa et al. | 333/248 |
| 5,982,255 | A * | 11/1999 | Tanizaki et al. | 333/239 |
| 2004/0222868 | A1 | 11/2004 | Rathgeber et al. | |
| 2010/0148891 | A1* | 6/2010 | Sano | 333/137 |
| 2012/0206213 | A1 | 8/2012 | Kojima et al. | |

FOREIGN PATENT DOCUMENTS

| | | |
|---|---|---|
| JP | 10-093311 | 4/1998 |
| JP | 10-224115 | 8/1998 |
| JP | 2003-318614 | 11/2003 |
| JP | 2012-147286 | 8/2012 |

* cited by examiner

*Primary Examiner* — Benny Lee
(74) *Attorney, Agent, or Firm* — Cozen O'Connor

(57) ABSTRACT

Provided is an input/output structure for a dielectric waveguide, comprising a rectangular-parallelepiped-shaped dielectric block, a plate-shaped dielectric plate, and a feeder line comprising a line-shaped electrically conductive foil sandwiched between the dielectric block and the dielectric plate.

4 Claims, 5 Drawing Sheets

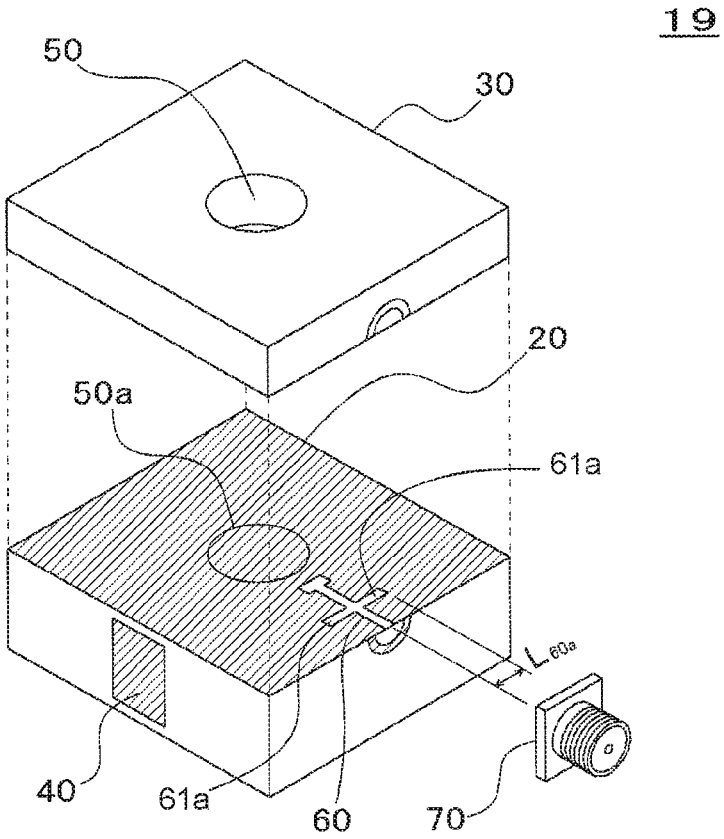
FIG. 4
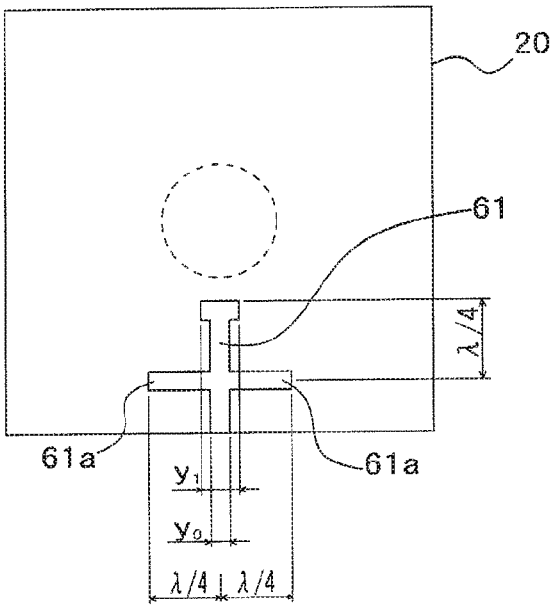

-- Prior Art --

DIELECTRIC WAVEGUIDE COMPRISED OF A DIELECTRIC BLOCK AND A DIELECTRIC PLATE SANDWICHING AN INPUT/OUTPUT FEEDER LINE

BACKGROUND OF THE INVENTION

1. Field of the Invention

The present invention relates to an input/output structure for a dielectric waveguide, and more particularly, to a structure for conversion between the dielectric waveguide and a coaxial line.

2. Description of the Related Art

A dielectric waveguide, which is obtained by providing an electrically conductive layer on a surface of a dielectric material, can eliminate the need for using a thick electrically conductive wall and effectively shorten an electromagnetic wave transmitted therethrough by virtue of the dielectric material, thereby to facilitate substantial reduction in size of the waveguide device as compared to a traditionally used hollow waveguide. Such a reduced in size waveguide device is small enough to be directly mounted on a substrate. Thus, an input/output structure has been used which employs a structure for conversion between the dielectric waveguide and the microstrip, formed by soldering the dielectric waveguide to a mounted substrate comprising a microstrip line for performing an input/output operation (see, for example, JP 2012-147286A).

FIG. 9 is an exploded perspective view of a dielectric waveguide filter employing a structure for conversion between the dielectric waveguide and the microstrip, which is a conventional dielectric waveguide input/output structure disclosed in JP 2012-147286A. As illustrated in FIG. 9, a dielectric waveguide filter 1 is formed by sequentially coupling dielectric waveguides 1*a*, 1*b*, 1*c*, 1*d* and 1*e*, each dielectric waveguide comprising a rectangular -parallelepiped-shaped dielectric block having an outer periphery covered with an electrically conductive layer. The dielectric waveguide filter 1 comprises:

a coupling window 4*a* between the dielectric waveguides 1*a* and 1*b;* a coupling window 4*b* between the dielectric waveguides 1*b* and 1*c;* a coupling window 4*c* between the dielectric waveguides 1*c* and 1*d*; and a coupling window 4*d* between the dielectric waveguides 1*d* and 1*e,* wherein each coupling window allows a dielectric body to be exposed. Each of the dielectric waveguides 1*a* and 1*e* positioned at either end of the dielectric waveguide filter 1 has a bottom surface having each of island-shaped electrodes 5*a* and 5*e* respectively, which is electrically insulated from the electrically conductive layer.

A printed circuit board 8 has a front surface having an island-shaped electrode 8*b* and a back surface having a microstrip 8*a*. The printed circuit board 8 also comprises a via-hole 8*c* for coupling the island-shaped electrode 8*b* and the microstrip 8*a* together. The dielectric waveguides la and le are arranged to allow the island-shaped electrodes 5*a* and 5*e* each provided on the respective bottom surface of the dielectric waveguides 1*a* and 1*e* to be opposed to the island-shaped electrodes 8*b* and 8*b* each provided on the respective front surface of the printed circuit boards 8 and 8, respectively.

LIST OF PRIOR ART DOCUMENTS

Patent Documents

Patent Document 1: JP 2012-147286A
Patent Document 2: JP 2003-318614A

SUMMARY OF THE INVENTION

Technical Problem

The inner portion of the dielectric waveguide is filled with the dielectric body. Thus, it is impossible to insert any structure into the dielectric waveguide. Therefore, when it is desired to couple the dielectric waveguide to a coaxial line, it is difficult to use a structure that has been used in a conventional hollow waveguide for conversion between a hollow waveguide and a coaxial line, in which the structure is formed by inserting a probe into the hollow waveguide. For this reason, it is required, as illustrated in FIG. 9, to use conversion from the dielectric waveguide through the microstrip to the coaxial line, by which conversion is once performed to the microstrip line 8*a*, and then further to a connector 7 with conversion from the microstrip to the coaxial line, resulting in a greater loss. Thus, there has been a problem that degradation in performance is unavoidable. Further, the microstrip 8*a* is required to have a certain level of length so as to prevent reduction in size of the printed circuit board 8. This has prevented reducing the size of the input/output structure.

Means for Solving the Problem

According to the present invention, there is provided an input/output structure for a dielectric waveguide having a dielectric body and an electrically conductive layer covering the dielectric body, wherein the dielectric waveguide comprises: a rectangular-parallelepiped-shaped dielectric block, a plate-shaped dielectric plate, and a feeder line comprising a line-shaped electrically conductive foil sandwiched between the dielectric block and the dielectric plate.

Effect of the Invention

The dielectric waveguide input/output structure of the present invention makes it possible to achieve an input/output structure with less degradation in performance because it can perform conversion directly between the dielectric waveguide and the coaxial line without without converting the waveguide to a microstrip. Further, this dielectric waveguide input/output structure makes it possible to reduce the size of the input/output structure because it eliminates the need for using a printed circuit board for the microstrip line.

BRIEF DESCRIPTION OF THE DRAWINGS

FIG. 3 is an exploded perspective view of a dielectric waveguide according to a second embodiment of the present invention.

FIG. 4 is a plane view of a dielectric block in FIG. 3.

DETAILED DESCRIPTION OF THE INVENTION (First Embodiment)

Figure 1:
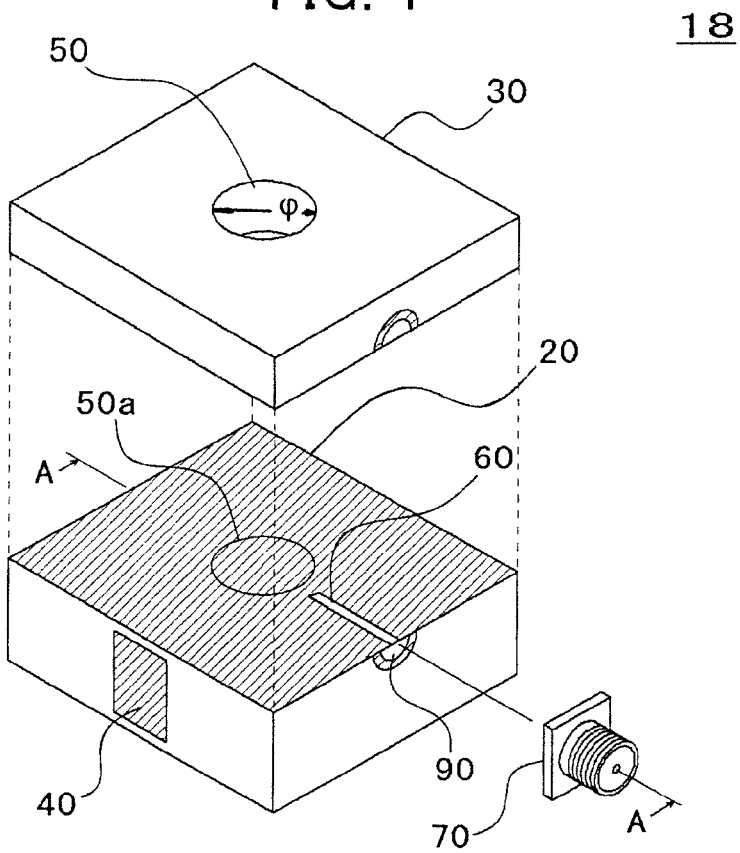
FIG. 1 is an exploded perspective view of a dielectric waveguide according to a first embodiment of the present invention.
Figure 2:
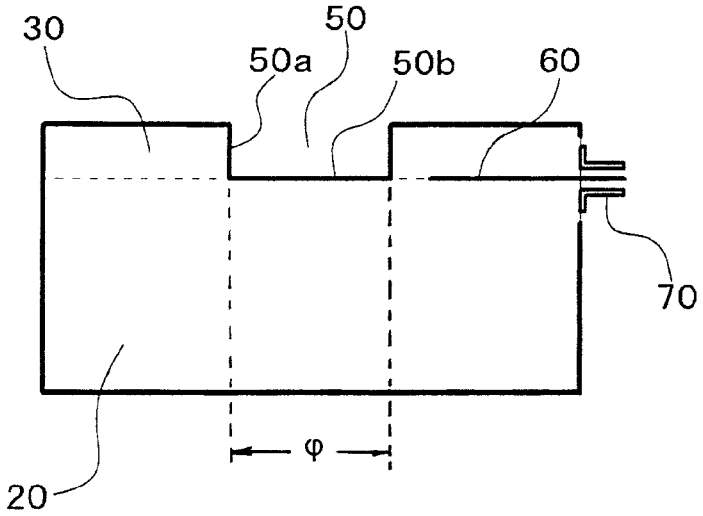
FIG. 2 is a cross-sectional view of the dielectric waveguide in FIG. 1 taken along the line A-A.

A first embodiment of the present invention will now be described with reference to the drawings. FIG. 1 is an exploded perspective view for describing in detail a first embodiment of a dielectric waveguide having a dielectric waveguide input/output structure of the present invention. FIG. 2 is a cross-sectional view of the dielectric waveguide in FIG. 1 taken along the line A - A. In FIG. 1, the shaded area represents an exposed dielectric portion. As illustrated in FIG. 1 and FIG. 2, the dielectric waveguide 18 comprises a rectangular-parallelepiped-shaped dielectric block 20, a plate-shaped dielectric plate 30 having a circular through-hole 50 with a diameter ϕ provided in an approximately central region thereof, and a feeder line 60 comprising a line-shaped electrically conductive foil sandwiched between the dielectric block and the dielectric plate. The dielectric waveguide 18 has an outer periphery including an inside surface 50*a* and a bottom surface 50*b* (FIG. 2) of the through-hole 50, which is covered with an electrically conductive layer. The feeder line 60 has an end portion coupled to an island-shaped electrode 90 (FIG. 1) that is insulated from the electrically conductive layer provided on a side surface of the dielectric waveguide 18. Thus, the dielectric waveguide 18 is exited from the side surface direction thereof. The dielectric waveguide 18 is coupled to an external device which is not shown via a connector 70 connected to the island-shaped electrode 90, and is also coupled to another dielectric waveguide via a coupling window 40 (FIG. 1) allowing a dielectric body to be exposed, provided on the side surface of the dielectric waveguide 18.

The dielectric block 20 and the dielectric plate 30 are coupled together using a joining glass, and the external electrically conductive layer, the island-shaped electrode 90 and the feeder line 60 are formed by printing a silver paste followed by sintering.

The dielectric waveguide 18 as described above exhibits less degradation in performance because it can perform conversion directly between the dielectric waveguide and the coaxial line. Further, the dielectric waveguide 18 can provide a downsized dielectric waveguide input/output structure because it eliminates the need for using a printed circuit board for the microstrip line.

This type of structure having a convex portion in the resonator, which is referred to as a re-entrant structure, is known to reduce the length in the axial direction of the dielectric waveguide to decrease the area occupied by the dielectric waveguide, and to be capable of suppressing a third harmonic that is not easy to be suppressed. If the dielectric waveguide 18 does not have the through-hole 50, it cannot be successfully oscillated by feeding electrical signals therewith from the direction of the side surface. Thus, providing the through-hole 50 has an effect that the dielectric waveguide 18 can be operated in a successful manner, that the length of the waveguide can be reduced, and that the third harmonic can be suppressed. Further, the dielectric waveguide 18 also has an effect of reducing unwanted radiations because it has a conversion section not exposed to the outside but located in the dielectric body.

In the re-entrant structure, the bottom surface 50*a* of the through-hole 50 has less influence on the characteristic of the structure even when it allows the dielectric body to be exposed. Thus, it may be possible to provide no electrically conductive layer on the bottom surface 50*a* of the through-hole 50.

Further, it is considered that the dielectric block 20 is operating in a mode close to a TE mode, while the dielectric plate 30 is operating in a mode close to a TEM mode. Thus, it is considered that the dielectric block 20 and the dielectric plate 30 are operating in different operation modes. Therefore, the boundary between the dielectric block 20 and the dielectric plate 30 has a small influence on the characteristic of the structure, and it has a small influence on the characteristic even in the presence of a gap caused by the joining glass between the dielectric block 20 and the dielectric plate 30. Preferably, the joining glass has a relative permittivity close to those of the dielectric block 20 and the dielectric plate 30.

Further, the relative permittivities of the dielectric block 20 and the dielectric plate 30 may be varied. The dielectric material having higher relative permittivity is expensive. Thus, it may be possible to reduce the cost of the dielectric waveguide input/output structure by, for example, employing for the dielectric plate 30 a less expansive dielectric material with lower relative permittivity than the dielectric block 20.

(Second Embodiment)

FIG. 3 is an exploded perspective view for describing in detail a second embodiment of a dielectric waveguide having a dielectric waveguide input/output structure of the present invention. FIG. 4 is a plain view of the dielectric block for describing in detail a feeder line in FIG. 3. In FIGS. 3 to 4, like numerals refer to the same parts as those described in FIGS. 1 to 2 and any overlapping description will be omitted. A dielectric waveguide 19 (FIG.3) according to the second embodiment has approximately the same structure as the dielectric waveguide illustrated in the first embodiment except for the shape of the feeder line 60 (FIG. 3).

As illustrated in FIG. 3 and FIG. 4, the feeder line 61 (FIG. 4) has a distal end having a width $y_1$ that is thicker than a width $y_0$ of a root portion thereof ($y_1>y_0$) as shown in FIG. 4, and the distal end of the feeder line 61 is spaced away from the through-hole 50 (FIG. 3) by a distance d (FIG. 4). Further, the feeder line 61 has an approximately quarter wavelength λ/4 open stub 61*a* provided on each of opposite sides at a position spaced away from a distal end thereof by an approximately quarter wavelength λ/4.

By providing the open stub 61*a*, it becomes possible to suppress the second harmonic. Further, by forming the feeder line 61 to have the distal end having a width $y_1$ that is thicker than a width $y_0$ of the root portion thereof, it becomes possible to improve the power durability by locating the distal end at a distance from the through-hole, and to achieve a larger bandwidth of the input/output structure by keeping the external Q at low level.

The dielectric waveguide 19 as described above can have an input/output structure with capability of suppressing the second harmonic, improved power durability and larger bandwidth by only changing the shape of the feeder line of the dielectric waveguide illustrated in the first embodiment.

(Third Embodiment)

Figure 5:
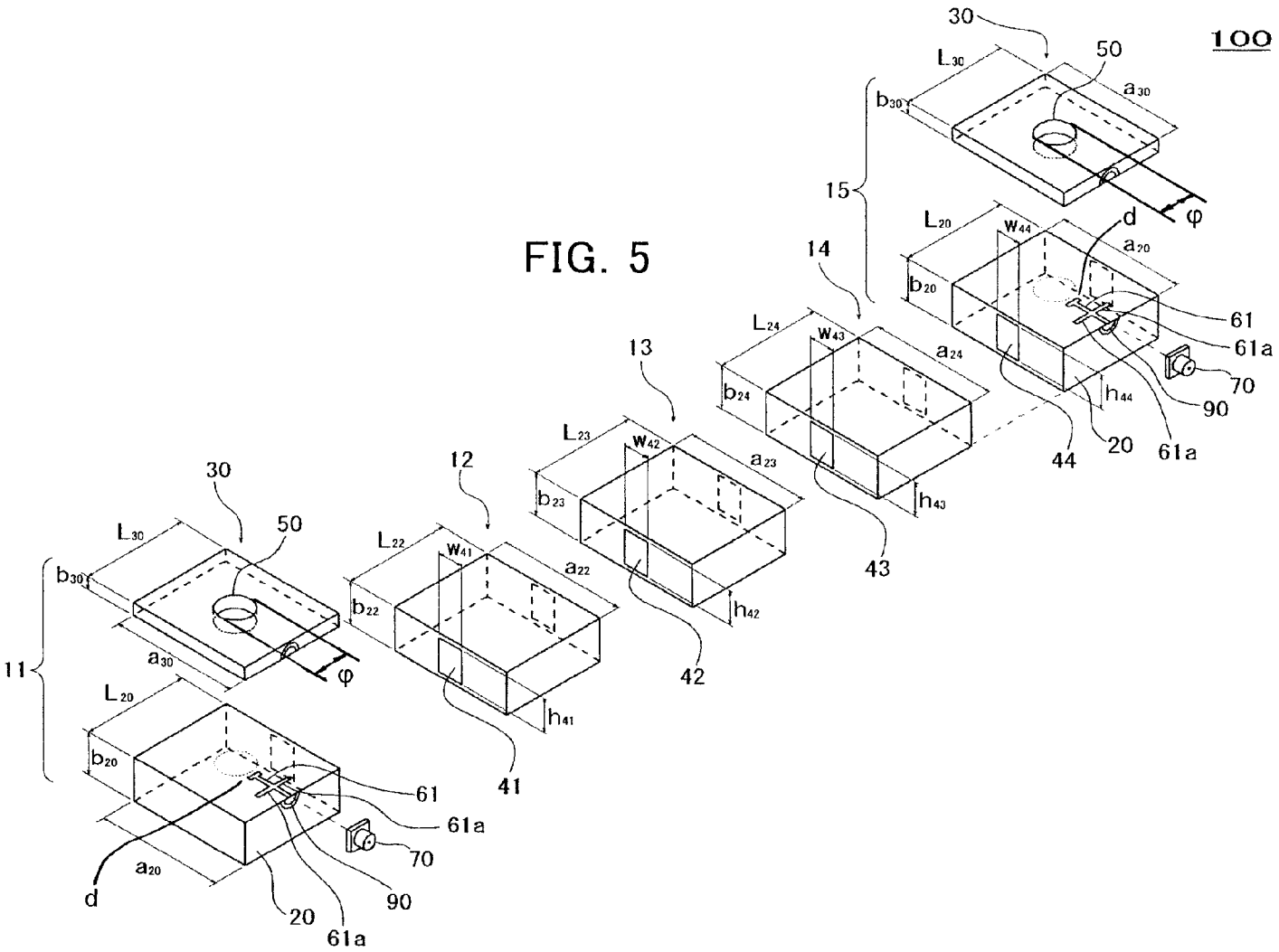
FIG. 5 is an exploded perspective view of a dielectric waveguide filter according to a third embodiment of the present invention.

FIG. 5 is an exploded perspective view of a third embodiment which the dielectric waveguide illustrated in the second embodiment is applied to a dielectric waveguide filter. As illustrated in FIG. 5, a dielectric waveguide filter 100 is formed by sequentially coupling rectangular-parallelepiped-shaped dielectric waveguides 11, 12, 13, 13, 15 each having an outer periphery covered with an electrically conductive layer. The dielectric waveguide filter 100 comprises:

a coupling window 41 between the dielectric waveguides 11 and 12;

a coupling window 42 between the dielectric waveguides 12 and 13;

a coupling window 43 between the dielectric waveguides 13 and 14; and a coupling window 44 between the dielectric waveguides 14 and 15, wherein each coupling window allows a dielectric body to be exposed.

Each of the dielectric waveguides 11 and 15 positioned at either side of the dielectric waveguide filter 100 comprises a rectangular-parallelepiped-shaped dielectric block 20, a plate-shaped dielectric plate 30 having a circular through-hole 50 with a diameter y in an approximately central region thereof, and a feeder line 61 comprising a line-shaped electrically conductive foil sandwiched between the dielectric block and the dielectric plate. The feeder line 61 has an end portion coupled to an island-shaped electrode 90 that is insulated from the electrically conductive layer provided on a side surface of the dielectric waveguides 11 and 15.

Each of the dielectric waveguides 11 and 15 is coupled to an external device which is not shown, via a connector 70 connected to the island-shaped electrode 90.

The feeder line 61 has a distal end having a width that is thicker than a width of a root portion thereof. Further, the feeder line 61 has an approximately quarter wavelength open stub 61*a* provided on each of opposite sides at a position spaced away from a distal end thereof by an approximately quarter wavelength.

The dielectric waveguide filter 100 as described above has an input/output structure with less degradation in performance because it employs a dielectric waveguide input/output structure that can perform conversion directly from the dielectric waveguide to the coaxial line. Further, this dielectric waveguide 100 can provide a reduced-in-size dielectric waveguide filter because it eliminates the need for using a printed circuit board for the microstrip line.

Figure 6:
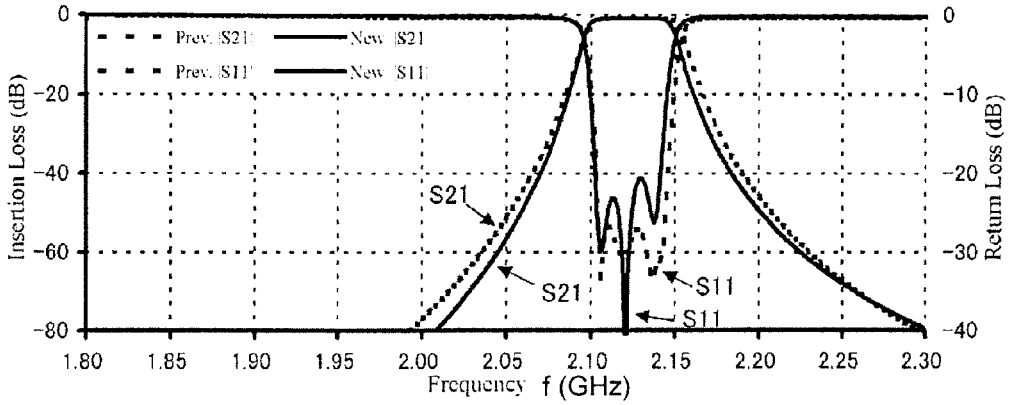
FIG. 6 is a graph illustrating a characteristic of the dielectric waveguide filter according to the third embodiment of the present invention.
Figure 7:
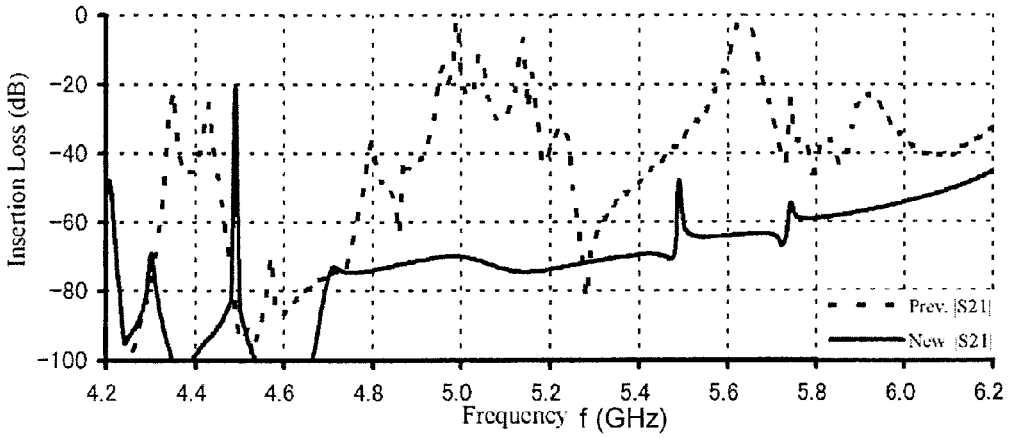
FIG. 7 is a graph illustrating a characteristic of the dielectric waveguide filter according to the third embodiment of the present invention.
Figure 8:
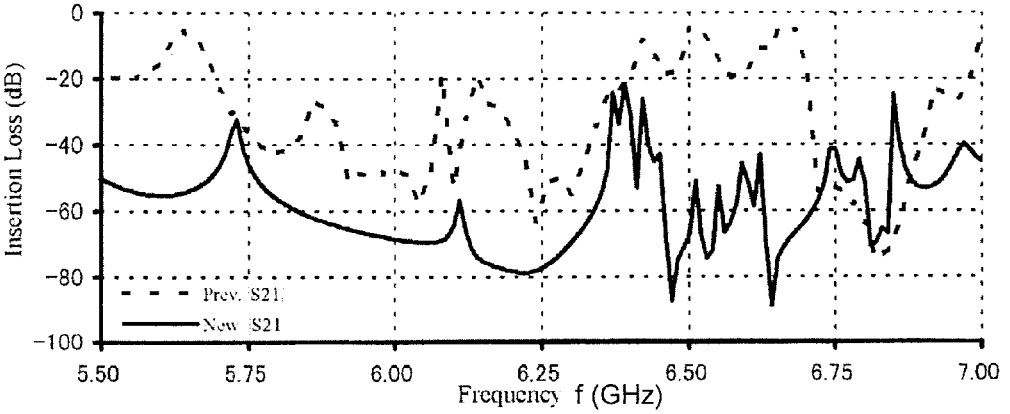
FIG. 8 is a graph illustrating a characteristic of the dielectric waveguide filter according to the third embodiment of the present invention.
Figure 9:
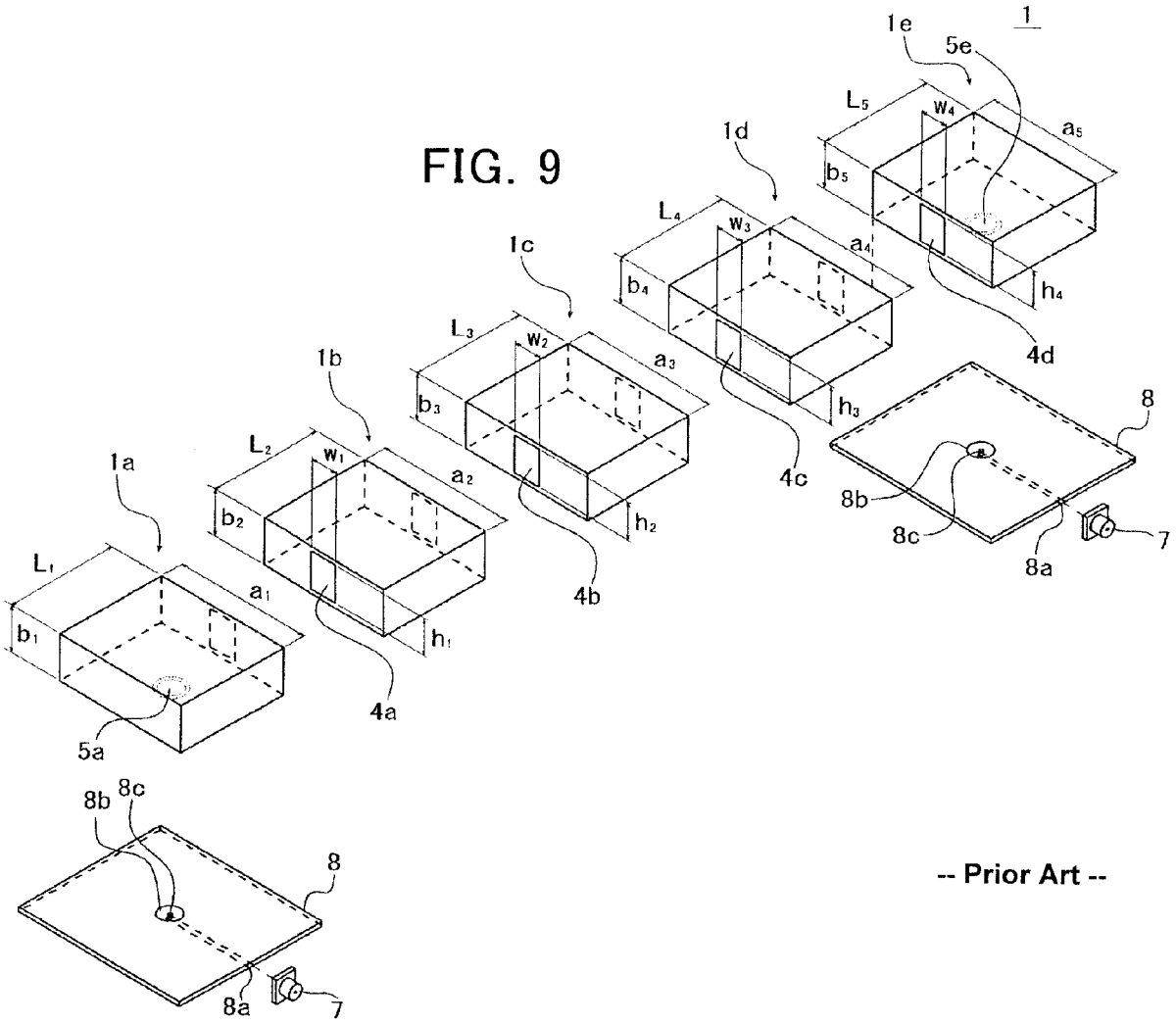
FIG. 9 is an exploded perspective view of a dielectric waveguide filter employing a conventional dielectric waveguide input/output structure.

FIGS. 6 to 8 are graphs illustrating a comparison result between the dielectric waveguide filter 100 according to the third embodiment of the present invention illustrated in FIG. 5 and the conventional dielectric waveguide filter 1 illustrated in FIG. 9. FIG. 6 is a graph illustrating a return loss (S11) and an insertion loss (S21) around a passband. FIG. 7 is a graph illustrating an insertion loss (S21) around a frequency band of double the passband. FIG. 8 is a graph illustrating an insertion loss (S21) around a frequency band of triple the passband.

In each figure, frequency f [GHz] is shown on a horizontal axis, [dB] is shown on a vertical axis, characteristic of the dielectric waveguide filter 100 is depicted in solid line, and characteristic of the dielectric waveguide filter 1 is depicted in dotted line.

Each of the dielectric waveguide filters 1 and 100 in FIGS. 1 and 5, respectively is designed to have a center frequency of the passband f0=2.12 [GHz] and a bandwidth fw=40 [MHz].

In the dielectric waveguide filter 100, each component has the following dimensions:

the dielectric block 20: $a_{20}\times b_{20}\times L_{20}$=24.0 mm×8.0 mm×15.00 mm;

the dielectric plate 30: $a_{30}\times b_{30}\times L_{30}$=24.0 mm×4.1 mm×15.00 mm;

the dielectric waveguide 12: $a_{22}\times b_{22}\times L_{22}$=24.0 mm×8.0 mm×20.14 mm;

the dielectric waveguide 13: $a_{23}\times b_{23}\times L_{23}$=24.0 mm×8.0 mm×20.39 mm;

the dielectric waveguide 14: $a_{24}\times b_{24}\times L_{24}$=24.0 mm×8.0 mm×20.14 mm;

the coupling window 41: $w_{41}\times h_{41}$=6.59 mm×3.0 mm;

the coupling window 42: $w_{42}\times h_{42}$=5.11 mm×3.0 mm;

the coupling window 43: $w_{43}\times h_{43}$=5.11 mm×3.0 mm;

the coupling window 44: $w_{44}\times h_{44}$=6.59 mm×3.0 mm;

in the feeder line 60, the distal end width $y_1$ (FIG. 4) is 1.6 mm, and the root portion width $y_0$ (FIG. 4)is 0.5 mm;

the through-hole 50 has a $\phi$=3.8 mm; and the distance d between the through-hole 50 and the feeder line 60 is 1.73 mm.

In the dielectric waveguide filter 1, each component has the following dimensions:

the dielectric waveguide 1*a*: $a_1\times b_1\times L_1$=24.0 mm×8.0 mm×22.86 mm;

the dielectric waveguide 1*b*: $a_2\times b_2\times L_2$=24.0 mm×8.0 mm×19.78 mm;

the dielectric waveguide 1*c*: $a_3\times b_3\times L_3$=24.0 mm×8.0 mm×19.91 mm;

the dielectric waveguide 1*d*: $a_4\times b_4\times L_4$=24.0 mm×8.0 mm×19.78 mm;

the dielectric waveguide 1*e*: $a_5\times b_5\times L_5$=24.0 mm×8.0 mm×22.86 mm;

the coupling window 4*a*: $w_1\times h_1$=6.59 mm×3.0 mm;

the coupling window 4*b*: $w_2\times h_2$=5.11 mm×3.0 mm;

the coupling window 4*c*: $w_3\times h_3$=5.11 mm×3.0 mm; and the coupling window 4*d*: $w_4\times h_4$=6.59 mm×3.0 mm.

All the relative permittivities $\in$ of the dielectric block and the dielectric plate are 20.0.

The result in FIG. 6 shows that the dielectric waveguide filter 100 of the present invention NEW |S11 and NEW |S21| and the conventional dielectric waveguide filter 1 PREV |S11| and PREV |S21| have approximately the same insertion loss (S11) and return loss (S21) respectively around the passband.

Further, the result in FIG. 7 shows that the dielectric waveguide filter 100 of the present invention NEW |S21| has a lower return loss (S21) than the conventional dielectric waveguide filter 1 PREV |S21| around a frequency band of double the passband.

Moreover, the result in FIG. 8 shows that the dielectric waveguide filter 100 of the present invention NEW |S21| has a lower return loss (S21) than the conventional dielectric waveguide filter 1 PREV |S21| around a frequency band of triple the passband.

Thus, the dielectric waveguide filter 100 of the present invention can exhibit less degradation in performance and can eliminate the need for using a printed circuit board for the microstrip line because it can perform conversion directly from the dielectric waveguide to the coaxial line without any conversion to the microstrip. Further, the dielectric waveguide filter 100 can provide a reduced-in-size dielectric waveguide input/output structure because the axial length of the dielectric waveguide can be shortened by having a re-entrant structure.

Further, the dielectric waveguide filter 100 makes it possible to suppress the second harmonic by having an open stub, and even to suppress the third harmonic, that is not easily suppressed, by having a re-entrant structure. Thus, a dielectric waveguide filter with lower harmonic generation can be achieved. As a result, it is not required to alternatively use a low-pass filter for suppressing the harmonic components.

Furthermore, the dielectric waveguide filter 100 also makes it possible to suppress unwanted radiations at the input/output conversion section because the feeder line and the open stub provided therewith are located within the waveguide and are not exposed to the outside.

The feeder line is drawn out to the direction orthogonal to the coupling direction of the dielectric waveguide. Alternatively, it may be drawn out to any direction. If the feeder line is pulled out to the longitudinal direction of the dielectric block, it is subject to less dimensional restriction than the case of being drawn out to the short-side direction, so that the distance between the distal end of the feeder line and the through-hole, for example, may be increased. This makes it possible to improve the power durability of the feeder line.

The dielectric waveguide input/output structure of the present invention is not limited to the input/output structure for the dielectric waveguide filter, but is applicable to various types of dielectric waveguide device having a connection to external devices.

EXPLANATION OF CODES

1*a* to 1*e*, 10 to 15, 18, 19: dielectric waveguide
20: dielectric block
30: dielectric plate
4*a* to 4*d*, 40 to 44: coupling window
50: through-hole
60, 61: feeder line
61*a*: open stub
7, 70: connector
8: printed circuit board
8*a*: microstrip
8*c*: via-hole
5*a*, 5*e*, 8*b*, 90: island-shaped electrode
1, 100: dielectric waveguide filter

What is claimed is:

1. A dielectric waveguide device employing an input/output structure for a dielectric waveguide comprising:

a rectangular-parallelepiped-shaped dielectric block;

a plate-shaped dielectric plate having a through hole extending through approximately a center thereof; and a feeder line comprising a line-shaped electrically conductive foil sandwiched between the dielectric block and the dielectric plate, wherein the dielectric block and the dielectric plate are coupled together to form the dielectric waveguide; and wherein the dielectric waveguide block is covered by an electrical conductive layer.

2. An input/output structure of a dielectric waveguide, the dielectric waveguide comprising:

a rectangular-parallelepiped-shaped dielectric block, a plate-shaped dielectric plate having a through-hole extending through approximately a center thereof, and a feeder line comprising a line-shaped electrically conductive foil sandwiched between the dielectric block and the dielectric plate;

wherein the dielectric block and the dielectric plate are coupled together to form the dielectric waveguide; and wherein the dielectric waveguide is covered by an electrical conductive layer.

3. The dielectric waveguide input/output structure as defined in claim 2, wherein the feeder line has an approximately quarter wavelength open stub provided on each of opposite sides at a position spaced away from a distal end thereof by an approximately quarter wavelength.

4. The dielectric waveguide input/output structure as defined in claim 3, wherein the distal end of the feeder line has a large width.

* * * * *